US005302576A

United States Patent [19]

Tokiyoshi et al.

[11] Patent Number: 5,302,576

[45] Date of Patent: Apr. 12, 1994

[54] IMAGE-RECEIVING PAPER FOR THERMAL TRANSFER RECORDING SYSTEM AND METHOD OF PRODUCING IT

[75] Inventors: Tomofumi Tokiyoshi; Yoshitaka Okumura; Yuichiro Hayashi; Hiromasa Kondo; Hiromichi Yasuda, all of Amagasaki, Japan

[73] Assignee: Kanzaki Paper Mfg. Co., Ltd., Tokyo, Japan

[21] Appl. No.: 9,563

[22] Filed: Jan. 26, 1993

[30] Foreign Application Priority Data

Jan. 31, 1992 [JP] Japan ..... 4-016002
Feb. 27, 1992 [JP] Japan ..... 4-041562

[51] Int. Cl.[5] ..... B41M 5/035; B41M 5/38

[52] U.S. Cl. ..... 503/227; 428/195; 428/206; 428/211; 428/913; 428/914

[58] Field of Search ..... 8/471; 428/195, 323, 428/913, 914; 503/227

[56] References Cited

U.S. PATENT DOCUMENTS 4,639,751 1/1987 Mori et al. ..... 503/227

FOREIGN PATENT DOCUMENTS 3028693 2/1988 Fed. Rep. of Germany .
57-182487 11/1982 Japan ..... 503/227
59-133092 7/1984 Japan ..... 503/227
59-182787 10/1984 Japan ..... 503/227
59-187892 10/1984 Japan ..... 503/227
60-110489 6/1985 Japan ..... 503/227
60-110492 6/1985 Japan ..... 503/227
60-192690 10/1985 Japan ..... 503/227
61-217289 9/1986 Japan ..... 503/227
61-225396 10/1986 Japan ..... 503/227
61-286187 12/1986 Japan ..... 503/227
63-19289 1/1988 Japan ..... 503/227
63-21185 1/1988 Japan ..... 503/227
1-253478 10/1989 Japan ..... 503/227

*Primary Examiner*—B. Hamilton Hess
*Attorney, Agent, or Firm*—Killworth, Gottman, Hagan & Schaeff

[57] ABSTRACT

An image-receiving paper for a thermal transfer recording system and a method of producing the same. The paper ensures excellent transfer, reproduction and fixability of ink dots as well as satisfactory image clearness, etc. A substrate contains a porous pigment in an amount of 6 to 20% by weight, which pigment has an apparent specific gravity under JIS-K-6220 of 0.10 to 0.50 g/cm$^3$. The angle of contact $\theta$ of the surface of the substrate with water is 75 to 120°. The substrate is coated or saturated with an aqueous coating composition comprising a pigment and a binder.

5 Claims, No Drawings

IMAGE-RECEIVING PAPER FOR THERMAL TRANSFER RECORDING SYSTEM AND METHOD OF PRODUCING IT

FIELD OF THE INVENTION

The present invention relates to improvements in an image-receiving paper for a thermal transfer recording system used in copying machines, printers, facsimiles, etc.

BACKGROUND OF THE INVENTION

Recently, with the development of office automation, copying machines, printers, facsimiles, etc. utilizing various recording systems such as an electrophotographic system and a thermal transfer recording system have been widely used. These recording systems are used also in CAD/CAM, etc. for example according to the purposes thereof. In this case, colored color materials are used for forming images. Usually these color materials are transferred to a recording medium such as a paper and a film sheet by melting, evaporating or sublimating said color materials, a recorded image being obtained by adhering, absorbing and dyeing actions.

Among these recording systems, attention has recently been paid to a thermal transfer recording system of a heat melting type in which an ink ribbon having a thermal-meltable ink layer comprising color materials is melted by the heat of a thermal head, said color materials being transferred to a recording sheet, a recorded image being obtained by adhering, absorbing and dyeing actions. This recording system has a characteristic feature that it is possible for use an plain paper (wood free paper) as a recording medium.

In said thermal transfer recording system, as in other recording systems, there are increasing demands for full-color recording, high-speed recording, clear images, high resolution, etc. In single-color recording or multi-color recording by a color-thermal transfer printer, an ink ribbon having color materials such as yellow, magenta, cyanogen and black as well as waxes and resins is combined with a recording sheet, a transfer image being formed on said recording sheet by means of a thermal head. Since inks of various colors lie one above the other, said thermal transfer recording system has the disadvantages that unevenness of image and loss of dots (ink) are liable to occur owing to the improper smoothness of the surface of the image receiving layer.

Various proposals have been made to improve the smoothness of the surface of the image receiving layer by coating or saturating a substrate with a coating composition comprising pigments and binders instead of using a plain paper as it is. These proposals include inventions specifying a Bekk smoothness (Japanese Patent Laid-Open Publication No. Sho 59-133092 and Japanese Patent Laid-Open Publication No. Sho 59-187892) and inventions providing a heat transfer image layer comprising specific pigments and binders (Japanese Patent Laid-Open Publication No. Sho 57-182487, Japanese Patent Laid-Open Publication No. Sho 59-182787, U.S. Pat. No. 4,639,751, Japanese Patent Laid-Open Publication No. Sho 60-11489, Japanese Patent Laid-Open Publication No. Sho 60-110492, Japanese Patent Laid-Open Publication No. Sho 60-192690, Japanese Patent Laid-Open Publication No. Sho 61-217289, Japanese Patent Laid-Open Publication No. Sho 61-286187, Japanese Patent Laid-Open Publication No. Sho 63-21185 and Japanese Patent Laid-Open Publication No. Hei 1-253478). Also, an image-receiving sheet comprising a non-coated plain paper using a specific paper-making filler is disclosed by Japanese Patent Laid-Open Publication No. Sho 61-225396, Japanese Patent Laid-Open Publication No. Sho 63-19289, etc. The prior art described above has some improvements but does not completely prevent unevenness of image or color difference at portions where color inks lie one above the other in multi-color recording, or the reduction of image clearness owing to the loss of dots or to the improper reproduction of dot shapes.

The inventors consider that it is insufficient to improve smoothness by strengthening calendering, etc. or to make a thermal transfer receiving layer contain specific pigments or binders. No practicable art has been developed so far which obviates all the disadvantages of the prior art and ensures an image-receiving sheet for a thermal transfer recording system, said image-receiving sheet ensuring excellent ink transfer and dot reproduction.

Recently, image-receiving sheets for a thermal transfer recording system are often subjected to printing. This situation requires that the image-receiving sheets have a suitable smoothness, surface strength, opacity, etc. Furthermore, paper dust produced in cutting the image-receiving sheets affects the working environment of the users. Such a trouble must be immediately remedied.

OBJECTS AND SUMMARY OF THE INVENTION

It is an object of the invention to provide an image-receiving paper for a thermal transfer recording system which paper has a high grade and ensures high image qualities.

It is another object of the invention to provide an image-receiving paper for a thermal transfer recording system which paper ensures excellent transfer, reproduction and fixability of dots as well as excellent resolution and image clearness.

It is a further object of the invention to provide an image-receiving paper for a thermal transfer recording system which paper is free from unevenness of image and loss of dots.

It is a still further object of the invention to provide an image-receiving paper for a thermal transfer recording system which paper is suitable for high-speed recording and full-color recording, said paper further having a good printability.

The inventors have found that an image-receiving paper for a thermal transfer recording system, comprising a substrate and an image-receiving layer thereon, said image-receiving layer being formed by coating or saturating said substrate with an aqueous coating composition, will have qualities much better than the above-mentioned conventional image-receiving papers if said substrate satisfies the following two conditions at the same time:

(1) Said substrate contains a porous pigment in an amount of 6 to 20% by weight, said pigment having an apparent specific gravity under JIS-K-6220 of 0.10 to 0.50 g/cm$^3$.

(2) The initial angle of contact $\theta$ of the surface of said substrate with water is 75 to 120°.

In the image-receiving paper of the present invention, the rate of change of the angle of contact R of the surface of said substrate with water may be below 0.5°/second. Said image-receiving paper may have an internal bonding strength under TAPPI UM-403 of 0.05 to 0.18 ft.lb. The image-receiving layer of said image-receiving paper may have a ten point mean roughness under JIS-B-0601 of 6 to 20 μm.

The present invention also includes a method of producing said image-receiving paper comprising a substrate containing a porous pigment in an amount of 6 to 20% by weight, said pigment having an apparent specific gravity under JIS-K-6220 of 0.10 to 0.50 g/cm$^3$, said substrate also containing an internal sizing agent, a surface sizing agent being applied to the surface of said substrate by means of a size press so that the angle of contact $\theta$ of the surface of said substrate with water is 75 to 120°, an image-receiving layer being formed on said substrate by coating or saturating said substrate with an aqueous coating composition, said coating composition comprising a pigment and a binder.

The present invention comprising the above ensures a closer contact between an ink ribbon and an image-receiving surface, improving the receptivity and fixability of dots, and reproducing high image qualities. As a result, it is possible to obtain an image-receiving paper for a thermal transfer recording system which paper is suitable for high-speed recording and full-color recording.

DETAILED DESCRIPTION

The present invention will now be described in detail. In the present invention, a substrate, which is a main portion of an image-receiving paper for a thermal transfer recording system, is given a suitable porosity and cushioning and a higher heat insulating effect to improve ink receptivity, a binder component of an aqueous coating composition being infiltrated into said substrate in the production process of the image-receiving paper to improve printability and cope with the problem of paper dust, said substrate being given a suitable water repellency, said substrate containing a specific filler. All these conditions combine to remarkably improve the heat insulating property of said substrate, increase ink receptivity, and minimize the unevenness and roughness of the surface of the image-receiving paper.

A first characteristic feature of the present invention is that the substrate contains a porous pigment as a filler in an amount of 6 to 20%, preferably 8 to 15% by weight, said pigment having an apparent specific gravity under JIS-K-6220 (hereinafter designated at "apparent specific gravity") of 0.10 to 0.50 g/cm$^3$, preferably 0.15 to 0.40 g/cm$^3$, more preferably 0.20 to 0.40 g/cm$^3$. Said porous pigment contains much air within its particles. The substrate is given a suitable porosity and cushioning by disposing said porous pigment (filler) between pulp fibers. Since the substrate has a good head insulating property and heat from a thermal head is properly stored on the surface of the image-receiving layer, the receptivity and fixability of transferred ink are improved very much. Furthermore, the opacity and smoothness of the substrate are improved. Therefore, the image-receiving paper for a thermal transfer recording system according to the present invention has remarkably improved qualities.

If a porous pigment having an apparent specific gravity of above 0.50 g/cm$^3$ is used, the porous pigment will not have the above-mentioned property, the substrate becoming dense with decreased pores, the heat insulating efficiency of the substrate being much reduced, the receptivity and fixability of transferred ink being affected. Since pores necessary for scattering light are decreased, the opacity of the substrate is remarkably reduced. If a porous pigment having an apparent specific gravity of below 0.10 g/cm$^3$ is used, the substrate will have too many pores and the heat insulating effect of the substrate will become too high. Therefore, heat from the thermal head is not easily cooled on the surface of the image-receiving layer, said heat being stored thereon, the bleeding and bridging of transferred ink dots being caused, the image qualities being reduced. Also, since the paper layer strength is extremely reduced, the image qualities will be deteriorated owing to the loss of transferred dots and paper dust, furthermore printability being affected.

If the amount of use of said specific porous pigment is below 6% by weight of the substrate, it is impossible to obtain the desired effects of the present invention. If the amount of use of said specific porous pigment is above 20% by weight of the substrate, the paper layer strength of the substrate will be reduced and paper dust will be produced. As a result, the image qualities will be affected and the image-receiving paper will not be suitable for use as a printing paper.

The porous pigment usable in the present invention may be any of the following for example as far as they have the above-mentioned apparent specific gravity: sea chestnut-shaped or spherical coagulated precipitated calcium carbonate comprising coagulated single particles, calcined kaolin, amorphous silica, zeolite, natural diatomaceous earth, calcined natural diatomaceous earth, etc. If said sea chestnut-shaped or spherical coagulated precipitated calcium carbonate, calcined kaolin or amorphous silica is used, the fixability of transferred ink and the reproduction of dot shapes are excellent and colors are reproduced well in multi-color printing. Therefore, in this case, it is possible to obtain an image-receiving paper for a thermal transfer recording system, which paper is free from color difference and ensures excellent gradation.

Said sea chestnut-shaped or spherical coagulated precipitated calcium carbonate comprises single particles (or primary particles) coagulated had to such an extent that coagulated particles (or secondary particles) are not separated by a normal dispersion force, said single particles being obtained when a calcium carbonate is synthesized and crystallized, said single particles having diameters of about 0.1 to 0.3 μm. In the sea chestnut-shaped coagulated precipitated calcium carbonate, said single particles are spicular. In the spherical coagulated precipitated calcium carbonate, said single particles are cubical or rhombohedral. The diameters of said coagulated particles can be controlled in a range of 0.5 to 20 μm. Particularly, coagulated particles having diameters of 1 to 10 μm attract attention for use in paper making.

Said calcined kaolin is divided into many kinds according to the degree of calcination, particle sizes, etc. Said amorphous silica is a non-crystal synthetic silica or silicate having no crystal structure in contrast with a crystal silica occurring in nature. Said amorphous silica is generally divided into silicone dioxide by a dry method, silicate by a wet method and aluminium silicate, all these being generally called "white carbon". Said amorphous silica is a coagulated structure of fine particles, single particles having diameters of 10 to 50 nm, secondary particles having diameters of 1 to several hundred μm.

In addition to said fillers, it is possible to use any one or more of the following fillers for example within a range not affecting the desired effects of the present invention: mineral pigments such as talc, kaolin, clay, delaminated kaolin, ground calcium carbonate, precipitated calcium carbonate, magnesium carbonate, titanium dioxide, alumina trihydrate, calcium hydroxide, magnesium hydroxide, zinc oxide, magnesium sulfate, calcium silicate, aluminium silicate, magnesium silicate, calcium sulfate, silica, sericite, bentonite and smectite; and corpuscles and hollow corpuscles of organic synthetic pigments such as polystyrene resin, urea resin, acrylic resin, melamine resin and benzoguanamine resin. Also, fillers contained in waste paper, broke, etc. may be regenerated and used.

A second characteristic feature of the present invention is that the initial angle of contact $\theta$ of the surface of the substrate with water is 75 to 120°, preferably 80 to 110°, thereby a binder component of the coating composition being pertinently infiltrated into the paper layers of the substrate, thus the adhesion of the paper layers and between the paper layers and the image-receiving layer being made stronger.

In the present invention, the binder component (aqueous component) of the coating composition is pertinently infiltrated into the substrate by adjusting the water repellency of the substrate to make the paper layers stronger and increase the surface strength, thereby troubles attributable to paper dust being prevented.

If the angle of contact $\theta$ is above 120°, the water repellency of the substrate surface is too high. Therefore, the binder component of the coating composition is less likely to infiltrate into the substrate and it is impossible to obtain a desired strong image-receiving paper of the present invention. As a result, it is impossible to eliminate paper dust. Furthermore, when the ink ribbon and the image-receiving paper are separated one from the other at the time of thermal transfer recording, the surface of the image-receiving layer is pulled up with transferred ink and transferred dots (ink) are lost, thereby image qualities being affected.

If the angle of contact $\theta$ is below 75°, said binder component of the coating composition infiltrates into the substrate too much. Therefore, the surface of the image-receiving layer becomes uneven and rough. In other words, the image-receiving layer can not have a uniform surface. Since an aqueous component infiltrates into the paper layers and fills up their pores, recording aptitudes such as ink receptivity are lost and image qualities are reduced.

Stockigt sizing degree, water absorptiveness by means of Cobb test, etc. generally given an index to the water repellency of a substrate. However, these methods are not suitable as such an index when an aqueous coating composition is applied to the substrate because determination requires much time as compared with the infiltration time of the coating composition into the substrate and furthermore determined values are must influenced by the basic weight of the paper.

Thus, in the present invention, an angle of contact method is newly employed, which method makes it possible to accurately measure the degree of infiltration of an aqueous coating composition into the substrate in a process of coating or saturating said substrate with said aqueous coating composition.

The angle of contact in the present invention is a value determined in accordance with TAPPI STD T 458 om-84 "Surface wettability of paper (angle of contact method)". In this method, the angle of contact between a drop of distilled water and a paper surface is determined. The initial angle of contact $\theta$ is determined 5 seconds after a small drop of water is placed on the paper surface.

The angle of contact $\theta$ can be adjusted by changing the kind and amount of an internal sizing agent used in making the substrate and/or the kind, amount, etc. of a surface sizing agent applied to the surface of the substrate. It is also possible to adjust the angle of contact $\theta$ by changing the degree of calendering. If both of the internal sizing agent and the surface sizing agent are used, the initial angle of contact $\theta$ can be more accurately adjusted and therefore the desired effects of the present invention can be obtained better.

In the present invention, any of the following internal sizing agents for example may be used: rosin sizes such as saponified rosin size, rosin emulsion size, alkylketene dimer size, alkenyl maleic anhydride size, higher fatty acid size, resin size, wax size and cationic synthetic size.

In the present invention, any of synthetic sizes such as $\alpha$-olefine-maleic adhydride size and styrene-acrylate size as well as said internal sizing agents may be used as a surface sizing agent. These surface sizing agents may be used together with any of the following for example: starch, polyacrylamide, polyvinyl alcohol, cellulose derivative, acrylate ester, latex, their derivatives and modified resins. The substrate may be applied with any of these surface sizing agents by any means for example as follows: size presses of two-roll type, gate-roll type, metering blade type, Billblade type, etc. and coaters of short dwell type, roll type, air knife type, blade type, spray type, etc. Any of said size presses is most preferably used in the present invention.

The rate of change of the angle of contact R of the surface of the substrate with water should be below 0.5°/second, preferably below 0.4°/second. This case forms one of preferable examples of the present invention because it is possible to control the moisture changes of the paper attributable to environmental changes. The rate of change of the angle of contact is calculated as follows:

$$R=(\theta-\theta')/55$$

where

R: the rate of change of the angle of contact $\theta$: the initial angle of contact (after 5 seconds)

$\theta'$: the angle of contact after 60 seconds

If the rate of change of the angle of contact R is above 0.5°/second, moisture within paper changes remarkably for example when the environment in which the paper is kept is changed rapidly from low humidity to high humidity. In this case, curls, puckers, cockles, etc. may occur, heat insulating property being affected, furthermore paper being liable to the stuck or prevented from moving smoothly at the time of printing.

If an internal boding strength under TAPPI UM-403 is determined with respect to an image-receiving paper comprising a substrate having a specific angle of contact as mentioned above, said substrate being coated with an aqueous coating composition, said coating composition comprising a pigment and a binder, then the determined value generally falls within a range of 0.05 to 0.18 ft.lb. If a ten point mean roughness under JIS-B-0601 is determined with respect to the surface of said image-receiving paper, then the determined value generally falls within a range of 6 to 20 μm. It is also possible to keep the angle of contact within said specific range by adjusting the degree of calendering the substrate. If the surface of the substrate is made smoother by calendering the substrate before it is coated with the aqueous coating composition, the smoothness of the surface of the substrate after the coating of the aqueous coating composition is necessarily made higher.

Said angle of contact, internal boding strength or ten point mean roughness can be adjusted by various means, which means should be used properly to obtain a desired value. If the internal boding strength or the ten point mean roughness is not within said specific range, there will be the same drawbacks as when the angle of contact is not within said specific range.

Some of conventional image-receiving papers for a thermal transfer recording system have an internal boding strength of above 0.20 ft.lb. These conventional image-receiving papers are insufficient in cushioning and flexibility even if the surface of the image-receiving layer thereof has a good smoothness. Therefore, when thermal transfer recording is made for example by pressing an ink ribbon and a thermal head against the surface of the image-receiving paper by means of a platen roll, the contact between the surface of the image-receiving paper and the ink ribbon is not uniform. This will result in an uneven image attributable to unevenness of image, loss of dots, etc. Thus the conventional image-receiving papers give poor image qualities.

If the internal boding strength is below 0.05 ft.lb., it is impossible to obtain an image-receiving paper having strong paper layers and a strong image-receiving layer surface which are desired in the present invention. Also, it is impossible to eliminate the trouble of paper dust. Furthermore, the surface of the image-receiving layer is pulled up with transferred ink and transferred dots (ink) are lost, thereby image qualities being affected.

The internal boding strength of the image-receiving paper for a thermal transfer system may be adjusted to said specific range of the present invention by changing any of the following: kind and amount of pulp fibers; beating conditions; kind and amount of fillers; kind and amount of wet-end strength agent; application of surface sizing agents and surface binders such as starch, polyvinyl alcohol and polyacrylamide; dewatering conditions, wet pressing conditions and drying conditions in the paper machine. These adjusting means may be chosen as required. The easiest and adjusting means is to keep the initial angle of contact $\theta$ of the surface of the substrate with water within a range of 75 to 120°.

Pulps used are not limited. The main pulp used is a usual wood fiber pulp. The following pulps may also be used as required: non-woody fiber pulps such as kenaf, bamboo and hemp; synthetic pulps and synthetic fibers such as polyester, polyolefin and polyamide; inorganic fibers such as glass fiber and ceramic fiber. Methods, etc. of producing pulps are not limited, either. For example, it is also possible to use chemical pulps or semi-chemical pulps such as softwood pulps and hardwood pulps obtained by a KP method, SP method, AP method, etc.; high yield pulps such as SGP, BSGP, BCTMP, CTMP, CGP, TMP, RGP and CMP; and waste paper stock or recycled paper stock such as DIP. Among these pulps, chemical pulps obtained from hardwoods such as maple, birch, oak, beech, aspen and eucalyptus are preferably used because they have excellent cushioning and heat insulation and further much increase ink receptivity.

The paper stuff, the main components of which are a pulp and fillers, may further contain any of conventional wet-end additives such as a retention aid agent, drainage acid agent and strength agent to such an extent that they do not affect the desired effects of the present invention.

It is also possible to add, as required, wet-end additives such as a dyestuff, fluorescent whitening agent, pH cotrol agent, anti-foaming agent, pitch control agent and slimecide. When said surface sizing agents are applied, a fluorescent whitening agent, water-resisting agent, anti-foaming agent, antistatic agent, pigment, dyestuff, etc. may be applied together with the surface sizing agents.

Any paper making method may be used in the present invention. For example, it is possible to use an acidic paper making method in which the paper making pH is about 4.5, as well as a neutral paper making method in which an alkaline filler such as calcium carbonate is contained as a main component and the paper making pH is about 6 (slightly acidic) to about 9 (slightly alkaline). Usable paper machines include a Fourdrinier paper machine, twin wire paper machine, cylinder paper machine, etc.

After paper making, drying, surface sizing and drying, the surface of the substrate is preferably smoothed by means of a machine calender which may be any of the following for example: a machine calender stack comprising a number of metal rolls; a gloss calender in which a roll is pressed against a drum; and a soft calender.

The substrate thus prepared can be used as it is as an image-receiving paper for a thermal transfer recording system. In the present invention, however, an image-receiving layer is formed by coating or saturating the substrate with an aqueous coating composition comprising a pigment and a binder in order to obtain an image-receiving paper for a thermal transfer recording system, said paper having desired high image qualities.

The binder contained in said aqueous coating composition may be any of the following high-molecular compounds which are at least water soluble or water dispersible: starch derivatives such as cationic starch, amphoteric starch, oxidized starch, enzyme modified starch, thermal chemical converted starch, starch esters and starch ethers; cellulose derivatives such as carboxymethyl cellulose and hydroxyethyl cellulose; natural or semi-synthetic high-molecular compounds such as gelatin, casein, soyabean protein and natural rubber; polydiens such as polyvinyl alcohol, isoprene, neoprene and polybutadien; polyalkenes such as polybutene, polyisobutylene, polypropylene and polyethylene; vinyl polymers or vinyl copolymers such as vinyl haloid, vinyl acetate, styrene, methacrylic acid, methacrylic ester, acrylamide and methyl vinyl ether; synthetic rubber latexes such as styrene-butadiene copolymer and methyl methacrylate-butadiene copolymer; synthetic resins such as urethane resin, polyester resin, acrylate resin, polyamide resin, olefin-maleic anhydride resin and melamine resin. One or more of these high-molecular compounds may be chosen according to the desired qualities of the image-receiving paper for a thermal transfer recording system.

To obtain the image-receiving paper for a thermal transfer recording system, said paper having high ink receptivity and desired high image qualities, an image-receiving layer is preferably formed by coating or saturating the substrate with an aqueous coating composition comprising a pigment as well as said binder.

The pigment may be any of the following pigments usually used for preparing coated papers: mineral pigments such as kaolin, delaminated kaolin, alumina trihydrate, satin white, precipitated calcium carbonate, ground calcium carbonate, calcium sulfate, barium sulfate, titanium dioxide, calcined kaolin, talc, zinc oxide, alumina, natural diatomaceous earth, magnesium oxide, magnesium carbonate, silica, white carbon, magnesium aluminosilicate, colloidal silica, bentonite, zeolite and sericite; and corpuscles and hollow corpuscles of organic pigment such as polystyrene resin, urea resin, melamine resin, acrylic resin and benzoguanamine resin. One or more of these pigments may be chosen according to the desired qualities of the image-receiving paper for a thermal transfer recording system. To obtain the desired effects of the present invention. It is desirable to use a pigment in an amount of 0 to 95% (solid matter) by weight, preferably 10 to 90% (solid matter) by weight. To increase the brightness of the recording paper, it is desirable to use a pigment having a powder whiteness of above 75%, preferably above 80%.

In addition to the pigment and binder, the aqueous coating composition may contain, as required, any of the following auxiliary agents for example: anionic surfactant, cationic surfactant, nonionic surfactant, amphoteric surfactant, pH control agent, viscosity control agent, softner, gloss aid, dispersing agent, flow modifier, conductive agent, waxes, stabilizer, ultraviolet absorbent agent, antistatic agent, crosslinking agent, sizing agent, fluorescent whitening agent, colorant, anti-foaming agent, water-resisting agent, plasticizer, lubricant, antiseptic agent and perfume.

The substrate is coated or saturated on one side or two sides thereof with an aqueous coating composition thus prepared. The aqueous coating composition should not be used more than necessary. It is desirable to use the aqueous coating composition in an amount of about 0.5 to 15 g/m$^2$, preferably about 1 to 10 g/m$^2$, per side (dry weight).

Means for coating or saturating the substrate with the aqueous coating composition may be any of the following for example: a blade coater, air knife coater, roll coater, reverse roll coater, bar coater, curtain coater, die slot coater, gravure coater. Champflex coater, brush coater, two-roll size press coater, metering blade size press coater, Billblade coater, short-dwell coater, gate roll coater, spray coater, pre-wet coater and float coater. These may be either on-machine coaters or off-machine coaters.

The image-receiving paper for a thermal transfer recording system thus prepared is smoothed in a normal drying process, surface treatment process, etc. and finished as a paper having a moisture content of about 3 to 10% by weight, preferably about 4 to 8% by weight. If the image-receiving paper is smoothed so that the surface of the image-receiving layer has a ten point mean roughness under JIS-B-0601 of about 6 to 20 μm, preferably about 8 to 18 μm, the desired effects of the present invention become very obvious.

If the surface of the image-receiving layer has a ten point mean roughness of above 20 μm, the surface of the image-receiving layer is not smooth enough and it is impossible to obtain the desired excellent recorded image of the present invention. Also, increased frictional resistance affects the movement of the image-receiving paper at the time of recording, thereby color difference of the recorded image being caused in color recording. If the surface of the image-receiving layer has a ten point mean roughness of below 6 μm, the paper layers may become too dense and therefore heat insulating property is much reduced. In this case, transferred dots for example are too small, the tint of a compound color portion on which a number of colors are placed being recognized to be different from the original tint, thus color reproduction being inferior. Also, the fixability of transferred ink is reduced, image qualities being affected by the loss or stain of transferred dots owing to physical rubbing.

The ten point mean roughness in the present invention was determined in accordance with JIS-B-0601 by means of a universal surface shape determining apparatus SE-3C (made by Kosaka Laboratory Ltd., Japan), the reference sampling length being 8 mm. In the determination of surface roughness, the vertical movement of a stylus was converted into electric quantity, thereby the roughness or the smoothness of paper surface was determined. Therefore, it was possible to accurately determine, independent of the air permeability of paper, fine roughness of paper which was considered difficult to determine by means of smoothness determining apparatuses of a general air leakage type such as a Bekk smoothness tester and Parker print sufr tester. As a result of the inventors' detailed study, it was found that the value of the determined ten point mean roughness had a much stronger interrelationship with the desired smoothness of the present invention than the value of central line mean roughness in which a wave on the surface of the image-receiving layer is cut off.

The image-receiving paper for a thermal transfer recording system is smoothed by conventional smoothing means such as a super calender, gloss calender and soft calender. In the smoothing operation, the image-receiving paper is preferably passed through pressure nips each comprising a metal roll heated to a temperature of above 50° C., preferably above 80° C., heated or non-heated elastic roll. Said smoothing means may be disposed either on the paper machine or off the paper machine. The type of the pressing means and the number of the pressure nips are pertinently decided in the same way as in the conventional smoothing means.

EXAMPLES

The following are some examples of the present invention. It is to be noted that the scope of the invention is not limited to these examples. "Parts" and "%" in the following examples and comparative examples respectively mean "parts by weight" and "% by weight" unless otherwise stated.

In the examples and comparative examples, a substrate and an image-receiving paper for a thermal transfer recording system were subjected to determination and quality evaluation, the results of which are shown in Tables 1 to 3.

Determination of Initial Angle of Contact and Rate of Change of Angle of Contact An initial angle of contact in case of distilled water was determined by a method specified in TAPPI STD T 458 om-84 "Surface wettability of paper (angle of contact method)". The angle of contact was determined by means of "FACE Angle Of Contact Method Model CA-D" (made by Kyowa Kaimen Kagaku Co., Ltd., Japan).

The initial angle of contact means an angle of contact determined 5 seconds after a small drop of water is placed on the paper surface. The rate of change of the angle of contact was calculated as follows:

$$R=(\theta-\theta')/55$$

where

R: the rate of change of the angle of contact $\theta$: the initial angle of contact (after 5 seconds)

$\theta'$: the angle of contact after 60 seconds

Determination of Image Density

A test pattern having a solid portion, a fret portion and a dot portion was prepared by means of a color printer of a thermal transfer recording system ("Model CHC-443" made by Shinko Electric Co., Ltd., Japan). The density of the solid portion in the recorded image was determined by means of a Macbeth densitometer ("Model RD-100 R" made by Macbeth Corporation, USA)

Evaluation of Unevenness of Image on Recorded Surface

The degree of unevenness of image of the solid portion on the recorded surface was visually evaluated, the results of which are shown in the tables by the following relative valuations:

◎: Very good. No uneven shade of color was found.

○: Good. Almost no uneven shade of color was found.

Δ: Poor. Uneven shade of color was found.

Evaluation of Dot Reproduction on Recorded Surface

The dot portion on the recorded surface was magnified 30 times by means of a dot analyzer ("DA-3000" made by KS Systems Inc., Japan) The degrees of the loss and sharpness (bleeding) of dots were visually evaluated, the results of which are shown in the tables by the following relative valuations:

◎: Very good. Dots were sharp. No dots were lost.

○: Good. Almost no bleeding or loss of dots was found.

Δ: Slightly poor. Bleeding or loss of some dots was found.

x: Poor. Bleeding or lost of many dots was found.

Determination of Internal Bonding Strength

Internal Bonding strength (ft. lb.) was determined in accordance with TAPPI UM-403 by means of an internal bond tester (made by Edwin H. Benz Company Inc., USA).

Determination of Ten Point Mean Roughness of Image-Receiving Layer Surface of Image-Receiving Paper The ten point men roughness (μm) of the surface of an image-receiving layer was determined in accordance with JIS-B-0601 by means of a universal surface shape determining apparatus SE-3C (made by Kosaka Laboratory Ltd., Japan), the reference sampling length being 8 mm.

Production of Paper Dust

An image-receiving paper was cut by means of a cutter. At that time, the production of paper dust was visually evaluated, the results of which are shown in the tables by the following relative valuations:

○: Good. No paper dust was found.

Δ: Slightly poor. Some paper dust was found.

x: Poor. Much paper dust was found.

Evaluation of Printing Strength

An image-receiving paper was subjected to printing by means of an RI printing tester (made by Akira Seisakusho Co., Ltd., Japan). The printing strength of the image-receiving paper was visually evaluated, the results of which are shown in the tables by the following relative valuations:

◎: Very good. No picking was found.

○: Good. Almost no picking was found.

Δ: Slightly poor. Some picking was found.

x: Poor. Much picking was found.

Determination of Curl 500 image-receiving sheets of paper wrapped up in a wrapping paper were let alone in a room at a temperature of 20° C. and a relative humidity of 30% for 8 hours. Then, the sheets were moved to another room at a temperature of 20° C. and a relative humidity of 65%, and unwrapped there. Immediately after that, the state of curl was determined in accordance with J. TAPPI No. 16 "Determination of curl of paper II" by means of a gauge of curl curvature. The curl curvature is obtained as follows:

$$\text{Curl curvature}=(I/R)\times 100$$

where

R: Radius of curl in cm

In the tables, the symbol "+" means that the curl is toward the printed surface, the symbol "−" meaning that the curl is toward the non-printed surface.

EXAMPLE 1

Preparation of Substrate

A pulp slurry comprising 10 parts NBKP (spruce, freeness: CSF 520 ml) and 90 parts LBKP (maple, freeness: CSF 480 ml) was mixed with 10 parts spherical coagulated precipitated calcium carbonate (apparent specific gravity: 0.38 g/cm$^3$) as a filler, 0.5 part alum, 0.6 part cationic starch and 0.07 part alkylketene dimer. This mixture was diluted with white water to obtain a paper stuff having a pH of 7.9 and a solids content of 0.95%. This paper stuff was made into a paper by means of a twin wire machine. Then, the paper was applied with oxidized starch and maleic anhydride surface sizing agent by means of a size press so that the coating weights, dry basis, were respectively 2 g/m$^2$ and 0.15 g/m$^2$. The paper was dried and passed through a 3-nip machine calender. Thus a substrate having a basis weight of 80 g/m$^2$ was obtained.

Preparation of Coating Composition

A pigment slurry was obtained by mixing 90 parts (solid matter, hereinafter the same) spindle-shaped precipitated calcium carbonate, 10 parts titanium oxide and 0.4 part (ratio of solid matter to pigment, hereinafter the same) polyacrylic soda, and dissolving the mixture in water by means of a Cowless dissolver. This pigment slurry was mixed with 20 parts polyvinyl alcohol, 5 parts oxidized starch and 1 part fluorescent whitening agent. The mixture was agitated and further mixed with water to obtain a coating composition having a solids content of 50% by weight.

Formation of Image-Receiving Layer

The coating composition thus obtained was applied to two sides of said substrate by means of a bar coater so that the total coating weight, dry basis, was 15 g/m$^2$. The substrate was dried and passed through a super calender having 11 nips, the temperature of metal rolls being 50° C., the nip linear pressure being 200 kg/cm. Thus an image-receiving paper for a thermal transfer recording system was obtained, said paper having a basis weight of 95 g/m$^2$.

EXAMPLE 2

A substrate and an image-receiving paper were obtained in the same way as in Example 1 except that the amount of said spherical coagulated precipitated calcium carbonate was 15 parts and the amount of said cationic starch was 1.0 part.

EXAMPLE 3

A substrate and an image-receiving paper were obtained in the same way as in Example 1 except that said filler consisted of 8 parts spherical coagulated precipitated calcium carbonate and 3 parts talc (apparent specific gravity: 0.75 g/cm$^3$) and said sizing agent was replaced by 0.5 part neutral rosin size.

EXAMPLE 4

A substrate and an image-receiving paper were obtained in the same way as in Example 1 except that the amount, dry basis, of said maleic anhydride surface sizing agent was 0.30 g/m$^2$.

EXAMPLE 5

A substrate and an image-receiving paper were obtained in the same way as in Example 1 except that said filler was replaced by 10 parts spherical coagulated precipitated calcium carbonate (apparent specific gravity: 0.32 g/cm$^3$).

COMPARATIVE EXAMPLE 1

A substrate and an image-receiving paper were obtained in the same way as in Example 1 except that said filler was replaced by 10 parts spindle-shaped precipitated calcium carbonate (apparent specific gravity: 0.59 g/cm$^3$).

COMPARATIVE EXAMPLE 2

A substrate and an image-receiving paper were obtained in the same way as in Example 1 except that said filler was replaced by 20 parts precipitated calcium carbonate (apparent specific gravity: 0.56 g/cm$^3$).

COMPARATIVE EXAMPLE 3

A substrate and an image-receiving paper were obtained in the same way as in Example 3 except that said filler was replaced by 15 parts ground calcium carbonate (apparent specific gravity: 0.80 g/cm$^3$) and a size press liquid was prepared without using said maleic anhydride surface sizing agent.

COMPARATIVE EXAMPLE 4

A substrate and an image-receiving paper were obtained in the same way as in Example 3 except that said filler consisted of 4 parts precipitated calcium carbonate and 8 parts talc.

COMPARATIVE EXAMPLE 5

A substrate and an image-receiving paper were obtained in the same way as in Example 1 except that the amount of said alkylketene dimer was 0.03 part and a size press liquid was prepared without using said maleic anhydride surface sizing agent.

COMPARATIVE EXAMPLE 6

A substrate and an image-receiving paper were obtained in the same way as in Example 1 except that the amount of said alkylketene dimer was 0.5 part.

COMPARATIVE EXAMPLE 7

A substrate and an image-receiving paper were obtained in the same way as in Example 1 except that said size press was not used in the preparation of the substrate.

COMPARATIVE EXAMPLE 8

A substrate and an image-receiving paper were obtained in the same way as in Example 1 except that said machine calender was not used in the preparation of the substrate.

COMPARATIVE EXAMPLE 9

A substrate and an image-receiving paper were obtained in the same way as in Example 1 except that the amount of said filler was 22 parts, the amount of said alkylketene dimer being 0.5 part, the amount of said cationic starch being 1.5 parts.

EXAMPLE 6

A pulp slurry comprising 5 parts NBKP (spruce, freeness: CSF 520 ml) and 95 parts LBKP (eucalyptus, freeness: CSF 460 ml) was mixed with 10 parts calcined kaolin (apparent specific gravity: 0.34 g/cm$^3$) as a filler, 0.5 part rosin emulsion sizing agent, 2.0 parts alum and 0.2 part cationic starch. This mixture was diluted with white water to obtain a paper stuff having a pH of 5.1 and a solids content of 1.0%. This paper stuff was made into a paper by means of a Fourdrinier paper machine. Then, the paper was applied with oxidized starch and styrene-acrylic surface sizing agent by means of a size press so that the coating weights, dry basis, were respectively 2 g/m$^2$ and 0.20 g/m$^2$. The paper was dried and passed through a 3-nip machine calender. Thus a substrate having a basis weight of 90 g/m$^2$ was obtained.

Preparation of Coating Composition

A pigment slurry was obtained by mixing 80 parts rice-shaped precipitated calcium carbonate, 20 parts titanium oxide and 0.4 part polyacrylic soda, and dissolving the mixture in water by means of a Cowless dissolver. This pigment slurry was mixed with 20 parts polyvinyl alcohol, 10 parts oxidized starch, 1 part fluorescent whitening agent and water to obtain a coating composition having a solids content of 40% by weight.

Formation of Image-Receiving Layer

The coating composition thus obtained was applied to one side of said substrate by means of an air knife coater so that the coating weight, dry basis, was 5 g/m$^2$. The substrate was dried and passed through a super calender having 11 nips, the temperature of metal rolls being 80° C., the nip linear pressure being 150 kg/cm. Thus an image-receiving paper for a thermal transfer recording system was obtained, said paper having a basis weight of 95 g/m$^2$.

EXAMPLES 7 TO 9

A substrate and an image-receiving paper were obtained in the same way as in Example 6 except that the filler was replaced by 10 parts calcined kaolin having an apparent specific gravity of 0.42 g/cm$^3$ (Example 7), 10 parts amorphous silica having an apparent specific gravity of 0.20 g/cm$^3$ (Example 8) or 6 parts amorphous silica having an apparent specific gravity of 0.13 g/cm$^3$ (Example 9).

EXAMPLE 10

A substrate and an image-receiving paper were obtained in the same way as in Example 8 except that the amount of said amorphous silica having an apparent specific gravity of 0.20 g/cm$^3$ was increased to 15 parts, the amount of said rosin emulsion sizing agent being increased to 0.7 part, the amount of said cationic starch being increased to 1.5 parts.

COMPARATIVE EXAMPLE 10

A substrate and an image-receiving paper were obtained in the same way as in Example 6 except that the filler was replaced by 15 parts kaolin having an apparent specific gravity of 0.60 g/cm$^3$ and a size press liquid was prepared without using said styrene-acrylic surface sizing agent.

COMPARATIVE EXAMPLE 11

A substrate and an image-receiving paper were obtained in the same way as in Example 8 except that said amorphous silica was replaced by 15 parts amorphous silica having an apparent specific gravity of 0.55 g/cm$^3$.

COMPARATIVE EXAMPLE 12

A substrate and an image-receiving paper were obtained in the same way as in Example 6 except that the filler was replaced by 15 parts amorphous silica having an apparent specific gravity of 0.13 g/cm$^3$, the amount of said rosin emulsion sizing agent being increased to 0.7 part, the amount of said cationic starch being increased to 1.5 parts.

COMPARATIVE EXAMPLE 13

A substrate and an image-receiving paper were obtained in the same way as in Example 6 except that the filler was replaced by 10 parts amorphous silica having an apparent specific gravity of 0.07 g/cm$^3$, the amount of said rosin emulsion sizing agent being increased to 0.7 part, the amount of said cationic starch being increased to 1.5 parts.

EXAMPLE 11

Preparation of Substrate

A pulp slurry comprising 5 parts NBKP (spruce, freeness: CSF 520 ml) and 95 parts LBKP (eucalyptus, freeness: CSF 460 ml) was mixed with 15 parts calcined kaolin (apparent specific gravity: 0.34 g/cm$^3$) as a filler, 1.0 part rosin emulsion sizing agent, 1.5 parts alum and 0.1 part cationic polyacrylamide. This mixture was diluted with white water to obtain a paper stuff having a pH of 5.4 and a solids content of 0.96%. This paper stuff was made into a paper by means of a Fourdrinier paper machine. Then, the paper was applied with oxidized starch and anionic polyacrylamide by means of a size press so that the coating weights, dry basis, were respectively 2 g/m$^2$ and 0.20 g/m$^2$. The paper was dried and passed through a 3-nip machine calender. Thus a substrate having a basis weight of 90 g/m$^2$ was obtained.

Preparation of Coating Composition

A pigment slurry was obtained by mixing 80 parts rice-shaped precipitated calcium carbonate, 20 parts titanium oxide and 0.4 part polyacrylic soda, and dissolving the mixture in water by means of a Cowless dissolver. This pigment slurry was mixed with 20 parts polyvinyl alcohol, 5 parts styrene-butadiene synthetic rubber latex, 1 part fluorescent whitening agent and water to obtain a coating composition having a solids content of 40%.

Formation of Image-Receiving Layer

The coating composition thus obtained was applied to one side of said substrate by means of an air knife coater so that the coating weight, dry basis, was 6 g/m$^2$. The substrate was dried and passed through a super calender having 11 nips, the temperature of metal rolls being 80° C., the nip linear pressure being 150 kg/cm. Thus an image-receiving paper for a thermal transfer recording system was obtained, said paper having a basis weight of 96 g/m$^2$.

EXAMPLE 12

A substrate and an image-receiving paper were obtained in the same way as in Example 11 except that the amount of said calcined kaolin was decreased to 8 parts, the amount of said cationic polyacrylamide being increased to 0.25 part.

COMPARATIVE EXAMPLES 14 and 15

A substrate and an image-receiving paper were obtained in the same way as in Example 11 except that the amount of said calcined kaolin was changed to 8 parts (Comparative Example 14) or 22 parts (Comparative Example 15), the amount of said cationic polyacrylamide being changed to 0.4 part.

As apparent from the tables, the image-receiving paper for a thermal transfer recording system according to the present invention had a high image density and superior dot reproduction with no unevenness of image or bleeding or loss of transferred dots. Also, said image-receiving paper was free from troubles attributable to paper dust and had excellent printability and high image qualities.

TABLE 1

| | Substrate | | Image-receiving paper | | | | | | | |
|---|---|---|---|---|---|---|---|---|---|---|
| | Initial angle of contact θ° | Rate of change of angle of contact °/second | Image density | Unevenness of image | Dot reproduction | Paper dust | Printing strength | Curl curvature | Internal bonding strength ft. lb. | Ten point mean roughnes μm |
| Example | | | | | | | | | | |
| 1 | 92 | 0.18 | 2.04 | ○ | ◎ | ○ | ○ | −1 | 0.091 | 11.0 |
| 2 | 83 | 0.33 | 2.10 | ◎ | ○ | ○ | ○ | −2 | 0.078 | 8.9 |
| 3 | 101 | 0.15 | 1.99 | ○ | ○ | ○ | ◎ | +1 | 0.117 | 11.4 |
| 4 | 108 | 0.09 | 2.07 | ◎ | ◎ | ○ | ○ | 0 | 0.073 | 10.6 |
| 5 | 95 | 0.31 | 2.02 | ◎ | ◎ | ○ | ◎ | −3 | 0.100 | 10.1 |
| Comp. Example | | | | | | | | | | |
| 1 | 110 | 0.07 | 1.78 | Δ | Δ | Δ | ○ | −1 | 0.167 | 17.8 |
| 2 | 84 | 0.27 | 1.89 | Δ | X | Δ | X | −4 | 0.053 | 15.3 |
| 3 | 88 | 0.09 | 1.76 | Δ | Δ | ○ | ◎ | +1 | 0.145 | 18.4 |

TABLE 1-continued

| | Substrate | | Image-receiving paper | | | | | | | |
|---|---|---|---|---|---|---|---|---|---|---|
| | Initial angle of contact θ° | Rate of change of angle of contact °/second | Image density | Unevenness of image | Dot reproduction | Paper dust | Printing strength | Curl curvature | Internal bonding strength ft. lb. | Ten point mean roughnes μm |
| 4 | 106 | 0.11 | 1.87 | Δ | Δ | ○ | ◎ | −2 | 0.136 | 17.5 |
| 5 | 72 | 0.49 | 2.01 | Δ | Δ | ○ | ◎ | −10 | 0.102 | 15.6 |
| 6 | 123 | 0.02 | 2.05 | Δ | X | X | X | 0 | 0.041 | 10.7 |
| 7 | 70 | 0.35 | 1.96 | Δ | Δ | Δ | X | −4 | 0.047 | 15.9 |
| 8 | 73 | 0.13 | 1.98 | Δ | Δ | ○ | ○ | −3 | 0.084 | 17.2 |
| 9 | 75 | 0.53 | 2.04 | Δ | Δ | Δ | X | −13 | 0.052 | 11.1 |

TABLE 2

| | Substrate | | Image-receiving paper | | | | | | | |
|---|---|---|---|---|---|---|---|---|---|---|
| | Initial angle of contact θ° | Rate of change of angle of contact °/second | Image density | Unevenness of image | Dot reproduction | Paper dust | Printing strength | Curl curvature | Internal bonding strength ft. lb. | Ten point mean roughnes μm |
| Example | | | | | | | | | | |
| 6 | 103 | 0.26 | 2.03 | ○ | ○ | ○ | ◎ | −2 | 0.109 | 12.7 |
| 7 | 99 | 0.20 | 2.00 | Δ | ○ | ○ | ◎ | −2 | 0.116 | 15.8 |
| 8 | 87 | 0.29 | 2.05 | ○ | ○ | ○ | ○ | −3 | 0.075 | 12.2 |
| 9 | 85 | 0.36 | 1.98 | ○ | Δ | ○ | ○ | −5 | 0.072 | 14.5 |
| 10 | 80 | 0.38 | 2.06 | ○ | ○ | ○ | ○ | −6 | 0.070 | 11.3 |
| Comp. Example | | | | | | | | | | |
| 10 | 89 | 0.38 | 1.82 | Δ | Δ | Δ | Δ | −6 | 0.058 | 16.0 |
| 11 | 96 | 0.22 | 1.94 | ○ | Δ | Δ | Δ | −3 | 0.056 | 14.4 |
| 12 | 68 | 0.51 | 1.99 | Δ | Δ | Δ | Δ | −16 | 0.059 | 17.3 |
| 13 | 77 | 0.44 | 1.95 | Δ | X | X | X | −8 | 0.048 | 15.7 |

TABLE 3

| | Substrate | | Image-receiving paper | | | | | | | |
|---|---|---|---|---|---|---|---|---|---|---|
| | Initial angle of contact θ° | Rate of change of angle of contact °/second | Image density | Unevenness of image | Dot reproduction | Paper dust | Printing strength | Curl curvature | Internal bonding strength ft. lb. | Ten point mean roughnes μm |
| Example | | | | | | | | | | |
| 11 | 89 | 0.27 | 2.06 | ◎ | ○ | ○ | ○ | −3 | 0.065 | 11.6 |
| 12 | 96 | 0.16 | 2.01 | ○ | ○ | ○ | ◎ | −2 | 0.157 | 14.0 |
| Comp. Example | | | | | | | | | | |
| 14 | 121 | 0.02 | 1.90 | Δ | Δ | ○ | ◎ | −1 | 0.203 | 17.1 |
| 15 | 76 | 0.42 | 2.02 | Δ | X | ○ | ○ | −4 | 0.090 | 12.3 |

What is claimed is:

1. An image-receiving paper for a thermal transfer recording system comprising a paper substrate and an image-receiving layer thereon, said image-receiving layer being formed by coating or saturating said paper substrate with an aqueous coating composition, wherein said paper substrate contains a porous pigment in an amount of 6 to 20% by weight, said pigment having an apparent specific gravity of 0.10 to 0.50 g/cm$^3$; and wherein the initial angle of contact of the surface of said paper substrate with water is 75° to 120°.

2. An image-receiving paper as claimed in claim 1 wherein the internal bonding strength thereof is 0.05 to 0.18 ft./lb.

3. An image-receiving paper as claimed in claim 1 wherein the rate of change of the angle of contact of the surface of said substrate with water is below 0.5°/second.

4. An image-receiving paper as claimed in claim 1 wherein said image-receiving layer has a ten point mean roughness of 6 to 20 μm.

5. An image-receiving paper as claimed in claim 1 wherein said aqueous coating composition comprises a pigment and a binder.

* * * * *